US007788893B2

(12) United States Patent
Beck et al.

(10) Patent No.: US 7,788,893 B2
(45) **Date of Patent: *Sep. 7, 2010**

(54) APPARATUS AND METHOD FOR PRODUCING COMPOSITE CABLE

(75) Inventors: Peter Joseph Beck, Christchurch (NZ); Rodney Alan Badcock, Lower Hutt (NZ); Marc Gregory Mulholland, Lower Hutt (NZ)

(73) Assignee: General Cable Superconductors Limited, Upper Riccarton, Christchurch (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 11/962,364

(22) Filed: Dec. 21, 2007

(65) Prior Publication Data

US 2009/0064651 A1 Mar. 12, 2009

Related U.S. Application Data

(60) Provisional application No. 60/871,262, filed on Dec. 21, 2006.

(51) Int. Cl.
*D02G 3/36* (2006.01)

(52) U.S. Cl. ..... 57/13

(58) Field of Classification Search ..... 57/13, 57/14, 17, 18

See application file for complete search history.

(56) References Cited

U.S. PATENT DOCUMENTS

| | | | | |
|---|---|---|---|---|
| 3,360,919 A | | 1/1968 | Burr | |
| 3,827,225 A | * | 8/1974 | Schoerner | 57/13 |
| 4,015,415 A | * | 4/1977 | Otsuki et al. | 57/314 |
| 4,549,391 A | | 10/1985 | Toda et al. | |
| 6,718,748 B1 | * | 4/2004 | Patterson | 57/58.55 |
| 6,725,071 B2 | | 4/2004 | Albrecht et al. | |
| 2002/0050057 A1 | | 5/2002 | Spichal | |
| 2003/0024818 A1 | | 2/2003 | Albrecht et al. | |
| 2005/0227873 A1 | | 10/2005 | Leghissa | |

FOREIGN PATENT DOCUMENTS

| | | |
|---|---|---|
| JP | 2003-092033 | 3/2003 |
| JP | 2003-331659 | 11/2003 |

(Continued)

OTHER PUBLICATIONS

M N Wilson, "Superconductors and accelerators: the Good Companions", IEEE Transactions on Applied Superconductivity, vol. 9, No. 2, Jun. 1999, pp. 111-121.

(Continued)

*Primary Examiner*—Shaun R Hurley
(74) *Attorney, Agent, or Firm*—Blank Rome LLP

(57) ABSTRACT

A cable winding machine for winding together a multiple number of subconductors into a composite cable includes holding means for holding a first subconductor in the machine direction, and in a predetermined orientation of the first subconductor about its longitudinal axis as it moves through the machine; a first rotating member arranged and rotate the second subconductor around the first subconductor as the second subconductor moves through the machine and one or more further rotating members arranged to hold further subconductors aligned in the machine direction and in a predetermined orientation about their longitudinal axes and rotate the further subconductors around the subconductors wound with one another in the first winding stage of the machine.

26 Claims, 9 Drawing Sheets

FOREIGN PATENT DOCUMENTS

| | | |
|---|---|---|
| JP | 2004-090967 | 1/2004 |
| WO | WO-03/100875 | 12/2003 |

OTHER PUBLICATIONS

J Nishioka, Y Hikichi, T Hasegawa, S Nagaya, N Kashima, K Goto, C Suzuki, T Saitoh, "Development of Bi-2223 multifilament tapes for transposed segment conductors", Physica C vols. 378-381 (2002) 1070-1072.

V Hussennether, M Oomen, M Leghissa, H W Neumüller, "DC and AC properties of Bi-2223 cabled conductors designed for high-current applications", Physica C 401 (2004) 135-139.

Suzuki et al "Strain properties of transposed segment conductors for a transmission cable", Physica C, vols. 392-396, (2003) pp. 1186-1191.

* cited by examiner

APPARATUS AND METHOD FOR PRODUCING COMPOSITE CABLE

REFERENCE TO PRIOR APPLICATION

This application claims the benefit of U.S. Provisional Application No. 60/871,262, filed Dec. 21, 2006 which is incorporated herein by reference.

BACKGROUND

The invention relates to an apparatus and method for forming wound cables, such as Roebel or Rutherford cable, that involves minimal bending of the conductor elements.

FIELD OF INVENTION

Many applications of high $T_c$ superconductors (HTS), such as power transformers and high current magnets, require higher current than the capacity of presently available conductor tape. High currents can be attained by forming cables of multiple subconductors in which the individual conductors or conductor elements are continuously transposed such that each subconductor is electromagnetically equivalent. In this way current is equally shared and AC losses minimised. A spiral arrangement of conductors on the surface of a cylinder achieves this, but with inefficient use of space so that the overall engineering current density of the winding is reduced. The Roebel bar and Rutherford cable are transposed conductor cable configurations which combine high packing density with rectangular cross-section. The Rutherford cable has been used extensively with low $T_c$ superconductors—see for example, M. N. Wilson, "Superconductors and accelerators: the Good Companions", IEEE Transactions on Applied Superconductivity, Vol. 9, No. 2, June 1999, pages 111-121. The Roebel bar is long established as a high current copper conductor configuration for transformers and has been fabricated using HTS conductor—see J. Nishioka, Y. Hikichi, T. Hasegawa, S. Nagaya, N. Kashima, K Goto, C Suzuki, T Saitoh, "Development of Bi-2223 multifilament tapes for transposed segment conductors", Physica C volumes, 378-381 (2002) 1070-1072; V Hussennether, M. Oomen, M. Leghissa, H. -W. Neumüller, "DC and AC properties of Bi-2223 cabled conductors designed for high-current applications", Physica C 401 (2004) 135-139; and Suzuki et. al. "Strain properties of transposed segment conductors for a transmission cable", Physica C, volumes 392-396, (2003) pages 1186-1191.

In addition to the requirement for high-current conductor most AC applications of HTS demand low AC loss. In general this means that conductors should be transposed, electrically decoupled, and have minimal transverse dimensions. Because of the typically ribbon-like form of HTS conductors, it may be desirable for AC applications to manufacture conductor with narrower subconductor width than the usual DC conductor. An application might be, for example, in parts of windings exposed to appreciable AC fields oriented perpendicular to the face of the conductor. This narrow subconductor conductor will need to be made into a transposed multisubconductor conductor to give adequate current capacity for many applications. The shorter the transposition twist pitch, the lower the effective intersubconductor resistivity can be while still keeping the subconductors magnetically decoupled—see M. N. Wilson, "Superconductors and accelerators: the Good Companions", IEEE Transactions on Applied Superconductivity, Vol. 9, No. 2, June 1999, pages 111-121,equation 3. Provided decoupling is achieved, lower intersubconductor resistivity improves electrical and thermal stability and facilitates electrical connection to the cable.

There are presently two main HTS tape conductor types in production or development. Multifilament silver or silver alloy-sheathed composite conductor using the superconducting cuprate of composition $(Bi,Pb)_{21}Sr_2Ca_2Cu_3O_x$ (otherwise known as Bi-2223) is produced in commercial quantities by a powder-in-tube (PIT) manufacturing process involving drawing, rolling, and thermal treatment processes. A typical conductor will consist of approximately 55 HTS filaments embedded in a silver or silver alloy matrix, will have a cross-section of about 4 mm by 0.2 mm and a critical current at 77 K in self-field of up to 150 A.

Roebel-type cabled conductor made from PIT subconductors has been disclosed in the literature—see J. Nishioka, Y. Hikichi, T. Hasegawa, S. Nagaya, N. Kashima, K Goto, C Suzuki, T Saitoh, "Development of Bi-2223 multifilament tapes for transposed segment conductors", Physica C 378-381 (2002) 1070-1072; and V Hussennether, M. Oomen, M. Leghissa, H. -W. Neumüller, "DC and AC properties of Bi-2223 cabled conductors designed for high-current applications", Physica C 401 (2004) 135-139.

Typically, the formation of a Roebel bar involves sequential steps in which the conductors are in turn laterally bent and then moved vertically. This places strain on the conductors and can damage them.

A method for forming Roebel bar cable by controlled bending of tapes of this type is described in U.S. Pat. No. 6,725,071 to C Albrecht, P Kummeth, P Massek, titled "Fully transposed high Tc composite superconductor, method for producing the same and its use". This takes account of the sensitivity of PIT tape to deformation-induced damage by imposing minimum limits on the edge-wise (i.e. in the plane of the tape) bending radius and bending zone length respectively of 100 times and 20 times the tape width. The resulting cable pitch for complete transposition is comparatively long.

"Second generation" or 2G HTS conductor is produced as a thin film of $YBa_2Cu_3O_7$ (Y-123) approximately 1 μm thick on a substrate of a base metal tape coated with various oxide films—see for example A. P. Malozemoff, D. T. Verebelyi, S. Fleshler, D. Aized and D. Yu "HTS Wire: status and prospects", Physica C, volume 386, (2003) pages, 424-430. Transposed 2G conductor has been disclosed—see Suzuki, Goto, Saitoh and Nakatsuka, "Strain Properties of Transposed Segment Conductors for a Transmission Cable", Physica C 392-396 (2003) 1186-1191. See also Japanese patent application publications 2003092033 and 2004030907.

Methods have been developed for laminating 2G wire with copper tape or electroplating with copper to protect the tape from thermal-electrical instability and, by locating the HTS film at or near the neutral axis for flat-wise (out-of-plane) bending, from mechanical stress. It is envisaged that standard conductor with around 4 mm width will be slit from the wide conductor. Edge-wise bending of 2G wire to form cables will, like PIT tape, be subject to limits on the minimum bending radius. There is, at present, no published data on the sensitivity of 2G wire to edge-wise bending. However, due to its different mechanical properties compared with silver and silver-alloy sheath material one might expect even more difficulty in edge-wise deformation.

SUMMARY OF INVENTION

In broad terms, in one aspect, the invention comprises a cable winding machine comprising:

holding means for holding a first subconductor along first axis;

a first rotating member for holding a second subconductor, the first rotating member rotating about the first axis;

a second rotating member for holding a third subconductor, the second rotating member rotating about the first axis;

a first aperture surrounding the first axis, in use, the first subconductor and the second subconductor passing through the first aperture;

a second aperture surrounding the first axis, in use, the first, second and third subconductors passing through the second aperture, the first and second subconductors passing through the first aperture before passing through the second aperture; and feeding means for propelling the subconductors through the machine.

Preferably, the cable winding machine is adapted for use with subconductors each having a substantially flat surface.

Preferably, the first and second rotating members retain flat surfaces of the first, second and third subconductors in substantially the same orientation relative to each other throughout their rotation. Preferably, the flat surfaces of the first, second and third subconductors are held parallel to each other.

Preferably, the holding means does not rotate and the second and third members each counter-rotate about an axis parallel to the first axis to retain the second and third subconductors in a fixed orientation.

Preferably, the first and second rotating members are both mounted on a third member that provides rotation about the first axis.

Preferably, the first and second rotating members are first and second subconductor spools. Preferably, the first and second subconductor spools are mounted to the third rotating member such that they can counter-rotate relative to the third rotating member to retain the flat surfaces of the second and third subconductors in the same orientation relative to the flat surface of first subconductor throughout rotation of the third member. Preferably, the first and second spools are coupled via a drive belt to a static shaft centred on the first axis such that rotation of the third rotating member causes counter-rotation of the first and second spools.

Preferably, the first aperture is an elongate slot.

Preferably, the first aperture is formed in a fourth rotating member, the fourth rotating member rotating about the first axis. Preferably, the fourth rotating member is coupled to the third rotating member via a drive shaft. Preferably, the fourth rotating member includes means to retain the first aperture in a predetermined orientation. Preferably, the means to retain the first aperture in a predetermined orientation is a system of belts and wheels driven from the third rotating member via the drive shaft.

Preferably, the fourth rotating member includes a third aperture offset from the first axis, wherein, in use, the third subconductor passes through the third aperture prior to passing through the second aperture. Preferably, the third aperture is an elongate slot retained in a predetermined orientation. Preferably, in use, the fourth rotating member rotates about the first at the same angular velocity as the second rotating member rotates about the first axis.

Alternatively, the second rotating member may be mounted on a fifth rotating member, the fifth rotating member providing rotation of the second rotating member about the first axis.

Alternatively, the second rotating member may be positioned subsequent to the first aperture in a direction of travel of the subconductors through the machine.

Preferably, the machine includes means to ensure that the subconductors are maintained at a predetermined tension through the machine.

In broad terms, in a second aspect, the invention comprises a cable winding machine comprising:

holding means for holding a first subconductor along a first axis;

a first rotating member for holding second and third subconductors, in use, the first rotating member rotating about the first axis;

a second rotating member, in use, the second rotating member rotating about the first axis;

wherein the second rotating member includes a first aperture about the first axis, through which the first and second subconductors pass and a second aperture remote from the first axis through which the third subconductor passes;

wherein the first and second rotating members rotate at the same angular velocity; a third member having a third aperture through which the first, second and third subconductors pass subsequent to the first and second apertures; and feeding means for propelling the first, second and third subconductors through the machine.

Preferably, the apertures are elongate slots. Preferably, the elongate slots are formed in the rotating members and the machine includes means to retain all of the elongate slots in a predetermined orientation relative to one another.

Preferably, the first rotating member includes a plurality of spools. Preferably, the spools are mounted on the first rotating member such that they maintain a predetermined orientation relative to the first subconductor throughout their rotation.

Preferably, the machine includes means to ensure that the subconductors are maintained at a predetermined tension through the machine.

In broad terms, in a third aspect, the invention comprises a method of producing a multi subconductor cable comprising the steps of:

a) providing a first subconductor along a first axis travelling in an operating direction;

b) providing a second subconductor rotating about the first axis and travelling in the operating direction;

c) passing the first subconductor and the second subconductor through a first aperture on the first axis so as to wind the second subconductor around the first subconductor;

d) providing a third subconductor, the third subconductor rotating about the first axis and travelling in the operating direction;

e) passing the first and second subconductors and the third subconductor through a second aperture on the first axis, the second aperture subsequent to the first aperture in the operating direction, to wind the third subconductor around the first and second subconductors.

Preferably, the first, second and third subconductors are substantially flat subconductors. Preferably the first, second and third subconductors each include a high $T_c$ superconducting layer. Preferably, the first, second and third subconductors have a serpentine shape.

Preferably, the first, second and third subconductors are retained in a predetermined orientation relative to each other about their longitude axes throughout the method.

Preferably, the method includes a step of ensuring that the subconductors are held at a predetermined tension.

In broad terms, in a fourth aspect, the invention comprises a cable winding machine comprising:

a plurality of pay-off spools attached to a rotating spool holder which allows the spools to maintain a constant fixed orientation holding means for holding a first subconductor along first axis and in a preferred orientation of its flat surface;

a first rotating member for holding a second subconductor, the first rotating member rotating about the first axis, the second subconductor held in substantially the same orientation of its flat surface as the first subconductor;

feeding means for propelling the subconductors through the machine.

a mechanism for synchronising the motion of the subconductors through the machine and the rotation of the rotating members;

fixing the subconductors to establish a displacement of the transition sections of each of the subconductor elements along the first axis;

Preferably the holding means are a series of apertures.

Preferably the apertures are elongate slots.

Preferably, the holding means does not rotate and the second member counter-rotates about an axis parallel to the first axis to retain the second subconductor in a fixed orientation.

Preferably, the first rotating member is mounted on a second member that provides rotation about the first axis.

Preferably, the machine includes means to ensure that the subconductors are maintained at a predetermined tension through the machine.

Preferably the feeding mechanism moves the subconductors through the machine in a stepwise fashion.

Preferably the subconductor motion is stepped to maintain constant strain in the subconductors.

Preferably each stepwise motion advances the first conductor by one complete transposition length.

Preferably the second subconductor is set up such that there is a displacement in the transition sections of the first and second subconductors of L/n where n is the total number of subconductors to be wound in the cable.

Preferably the third subconductor is set up such that there is a displacement in the transition sections of the first and third subconductors of 2×L/n where n is the total number of subconductors to be wound in the cable.

BRIEF DESCRIPTION OF THE DRAWINGS

Preferred embodiments of the invention are described with reference to the accompanying drawings, in which.

DETAILED DESCRIPTION OF PREFERRED FORMS

Figure 1:
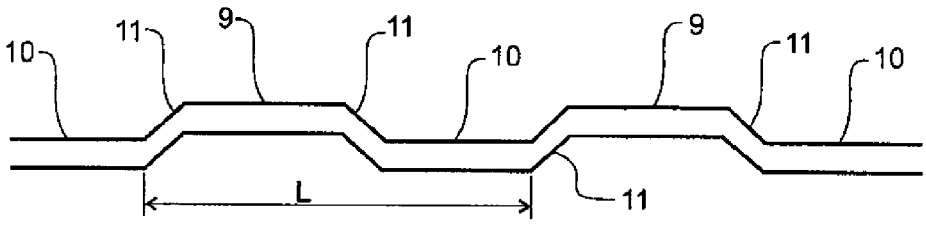
FIG. 1 shows a subconductor suitable for use in an apparatus in accordance with the present invention.

FIG. 1 shows a length of serpentine subconductor, which is the preferred shape for use in a winding machine and method of the present invention. The subconductor comprises straight sections 9 and 10 and transition sections 11. The relative size and shape of the straight sections and transition sections can be chosen to suit a particular finished cable. It is desirable to shape the subconductors so that there are both lateral and longitudinal spaces formed between the subconductors in the finished cable as shown in FIG. 2. The length L shown is the transposition length of the subconductor.

Figure 2A:
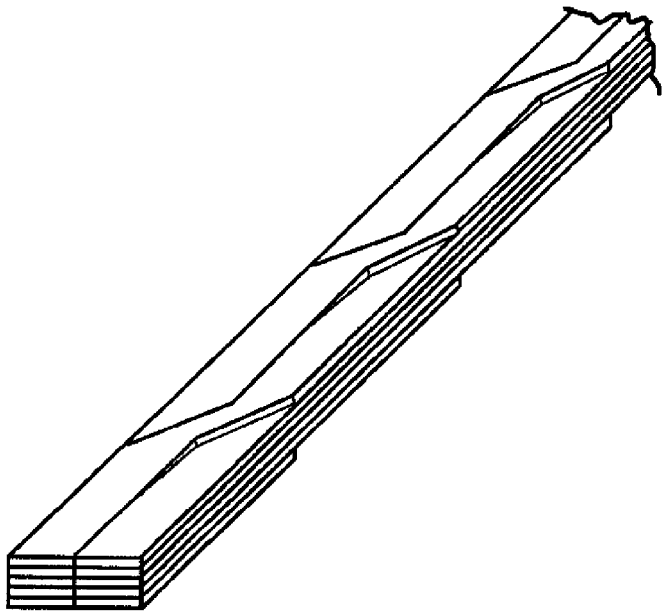
FIG. 2*a* shows a length of Roebel cable formed from ten subconductors and FIG. 2*b* shows a length of Roebel cable formed from three subconductors, in each case of the type shown in FIG. 1.
Figure 2B:
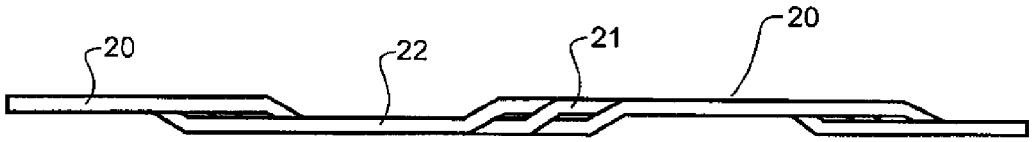

FIGS. 2*a* and 2*b* show a lengths of Roebel cable consisting of ten and three wound subconductors of the type shown in FIG. 1 respectively. In FIG. 2*b* the three subconductors are indicated at 20, 21, 22. In each case the subconductors are wound around each other along their entire length. The invention relates to a method and apparatus for producing composite cable of this type, from suconductors shown in FIG. 1.

The invention is particularly useful for producing composite superconducting cable. This is because the invention allows subconductors to be wound around one another with minimal stress on the subconductors. Superconducting wires typically consist of a flat substrate layer on which a layer or thin film of HTS crystal is formed. Stresses on the wires caused by bending, flexing and twisting can damage the crystal structure of the HTS layer and so reduce conductivity.

Figure 3:
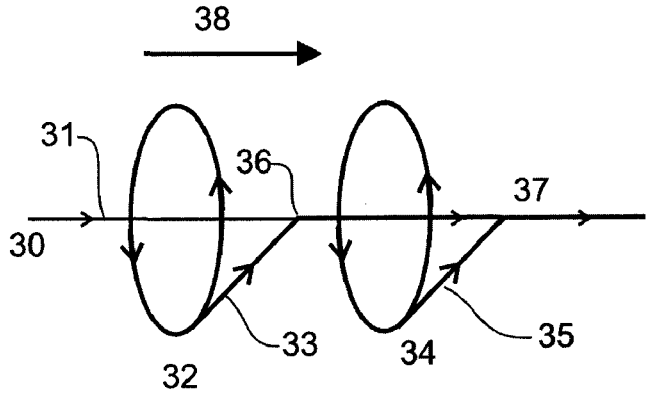
FIG. 3 is a schematic illustration of a sequential subconductor winding method in accordance with the invention.

FIG. 3 illustrates schematically a sequential winding method in accordance with the invention. A first subconductor 31 is provided from a first subconductor source 30 and extends and travels in a first direction indicated by arrow 38. A second subconductor 33 is provided from a second subconductor source 32. The second subconductor source 32 rotates about an axis defined by the path of the first subconductor 31. The second subconductor and the first subconductor both pass through an aperture 36. The rotation of the second subconductor 33 about the first subconductor 31 winds the second subconductor around the first subconductor so that they are combined subsequent to passing through aperture 36. The subconductors are each tensioned and the aperture 36 is dimensioned to ensure that the subconductors are closely wound together. A third subconductor 35 is provided from a third subconductor source 34 that rotates about an axis defined by the first and second subconductors 31, 33. The third subconductor passes through an aperture 37 with the first and second subconductors 31, 33. The rotation of the third subconductor winds it around the first and second subconductors in the same manner as the second subconductor is wound around the first subconductor. Again appropriate tension and aperture size ensures a close winding and results in a cable as shown in FIG. 2.

The sequential winding process described with reference to FIG. 3 can be extended to wind as many subconductors as required in a finished cable. Furthermore, any one of the subconductors can itself be formed from multiple wound subconductors.

Figure 4:
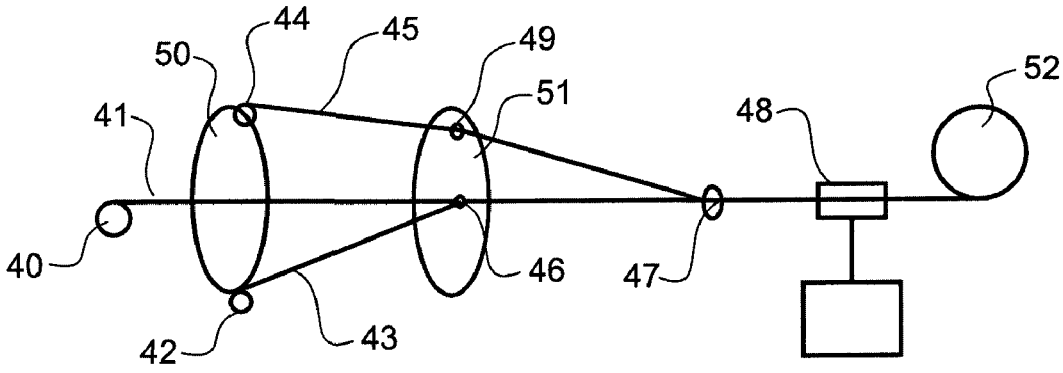
FIG. 4 is a schematic illustration of a preferred embodiment of a cable winding machine in accordance with the invention.

FIG. 4 is a schematic illustration of a preferred cable winding machine in accordance with the invention. A first subconductor 41 is provided from a first spool 40 and extends along a straight path to a conveyor 48. The conveyor 48 grips and pulls the subconductors through the machine. A preferred form of the conveyor 48 is described in detail with reference to FIG. 10. A second subconductor 43 is provided from a second spool 42 and extends through the machine to the conveyor 48. A third subconductor 45 is provided from a third spool 44 and also extends through the machine to conveyor 48.

The second and third spools 42, 44 are mounted on a first member 50 rotating about the first subconductor 41. Accordingly, both the second and third subconductors 43, 45 rotate about the first subconductor 41. The second subconductor is constrained to pass through a first aperture 46, formed in a second rotating member 51 at its axis of rotation. The first aperture 46 is dimensioned so that there is minimal clearance between the aperture and the first and second subconductors. This, together with sufficient tension in the subconductors ensures that the second subconductor is closely wound about the first subconductor.

The second rotating member 51 also includes a second aperture 49, offset from the first subconductor 41. The third subconductor 45 passes through the second aperture 49. The second rotating member 51 rotates about the first subconductor 41 at the same angular velocity as the first rotating member 50.

Subsequent to passing through second aperture 49, the third subconductor 45 passes through a third aperture 47 together with the combined first and second subconductors 41, 43. The third aperture 47 is positioned on the axis of rotation of the first and second rotating members. The third aperture 47 is dimensioned so that there is minimal clearance between the aperture and the first, second and third subconductors. This, together with sufficient tension in the subconductors ensures that the third subconductor is closely wound about the first and second subconductors.

The composite cable of first, second and third subconductors then pass through conveyor 48 and on to a take-up spool 52.

Figure 5A:
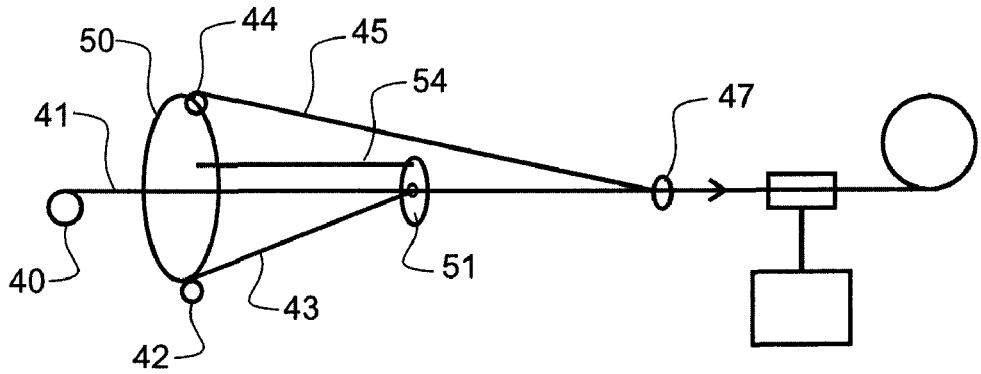
FIGS. 5*a-c* are schematic illustrations of alternative cable winding machines in accordance with the invention.
Figure 5B:
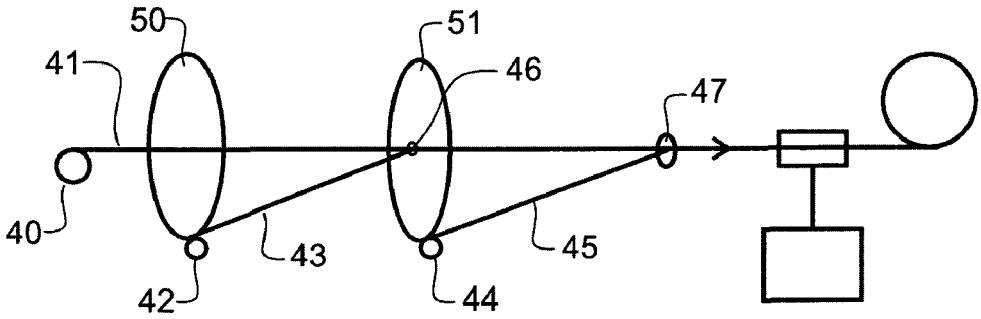
Figure 5C:
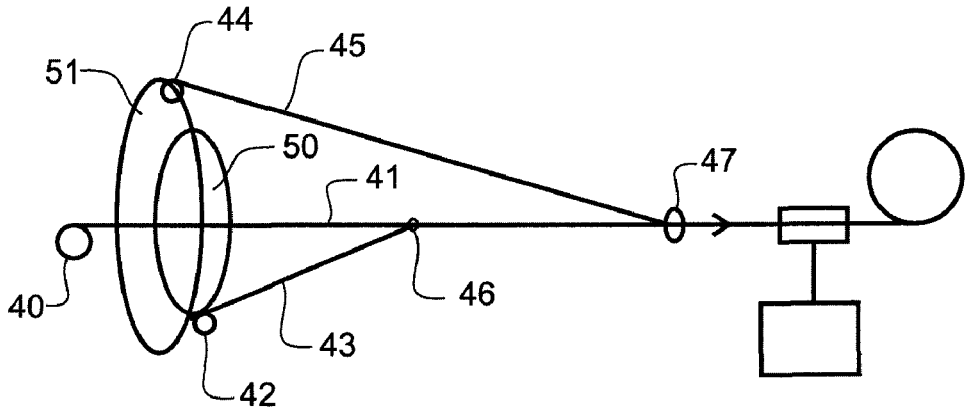

The machine described with reference to FIG. 4 is one possible arrangement in accordance with the present invention. Further details of this preferred arrangement are described with reference to FIGS. 6 to 10. FIGS. 5*a* to 5*c* illustrate other possible configurations.

FIG. 5*a* illustrates a configuration similar to that shown in FIG. 4 but the third subconductor does not pass through second member 51 but passes around the outside of it. In this embodiment second member 51 is connected to and supported by the first rotating member via a drive shaft 54.

FIG. 5*b* illustrates a configuration in which the third subconductor spool is mounted on a second rotating member, remote from the second subconductor spool 42. The second rotating member includes aperture 46 for combining the first and second subconductors, although it is possible that the aperture 46 is provided on a separate member.

FIG. 5*c* illustrates a configuration similar to FIG. 5*a*. However in FIG. 5*b*, the third spool is mounted at a greater radial distance from the axis of rotation than the second spool. The third spool is also optionally mounted on a separate rotating member to the second spool but rotates at the same angular velocity.

Figure 6:
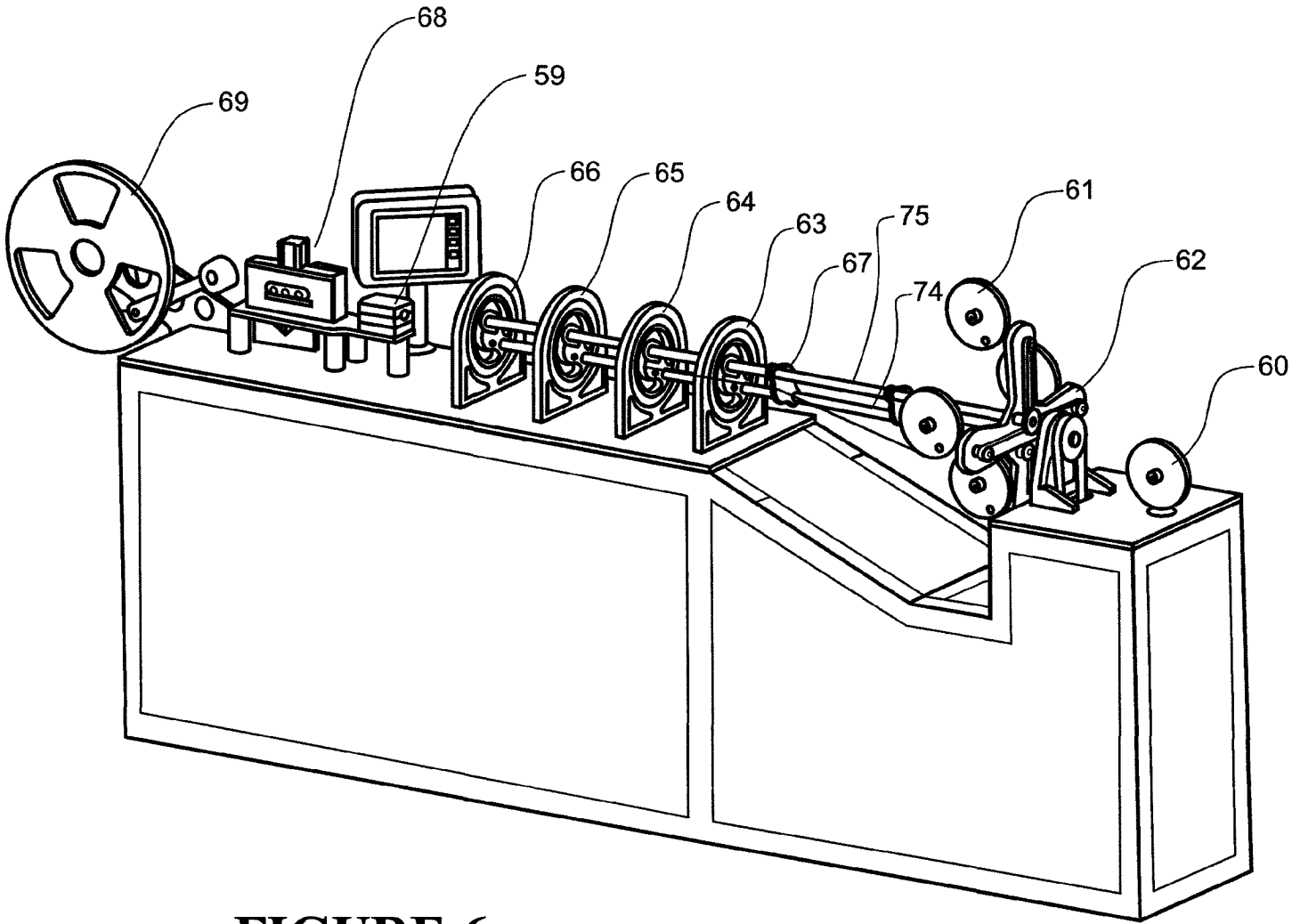
FIG. 6 is a perspective view of the embodiment illustrated in FIG. 4.

FIG. 6 is a perspective view of a preferred cable winding machine in accordance with the present invention, as illustrated in FIG. 4. The machine comprises a first subconductor spool 60 for dispensing a first length of subconductor. The first subconductor spool 60 is fixed to a machine floor. Four further subconductor spools 61 for dispensing second, third, fourth and fifth subconductors are mounted to a rotating member 62. The rotating member 62 is mounted to the machine floor and is free to rotate about a central axis. The first subconductor spool 60 is aligned with the central axis such that the first subconductor can extend from the spool 60 along the central axis with minimal bending or stress on the first subconductor.

Drive shafts 74, 75 extend from the rotating member 62 parallel to the central axis. The drive shafts (one of which is rotating about its own longitudinal axis) are rigid and provide rotational force to the rotating wheels 63, 64, 65, 66 and to plate 67. The rotating member 62 and each of the wheels 63-66 rotate at the same angular velocity and about the same central axis. The construction of each of the rotating wheels 63, 64, 65, 66 is described in greater detail with reference to FIG. 9. Each rotating wheel includes apertures through which the subconductors pass. At the first rotating wheel 63, each subconductor passes through a separate aperture. At each subsequent rotating wheel one of the second, third, fourth or fifth subconductors passes through a central aperture and so is wound around the first subconductor extending along the central axis. The unwound subconductors pass through apertures offset from the central axis and remain parallel to the central axis. The number of wheels in the machine is determined by the number of subconductor subconductors that are required in the finished cable. All the subconductors pass through stationary slit 59.

A drive unit 68 is used to grip the wound subconductors and pull them through the machine. The construction of the drive unit 68 is described in more detail with reference to FIG. 10. A take up roller 69 is positioned down stream of the drive unit to receive and store the wound cable.

Figure 7:
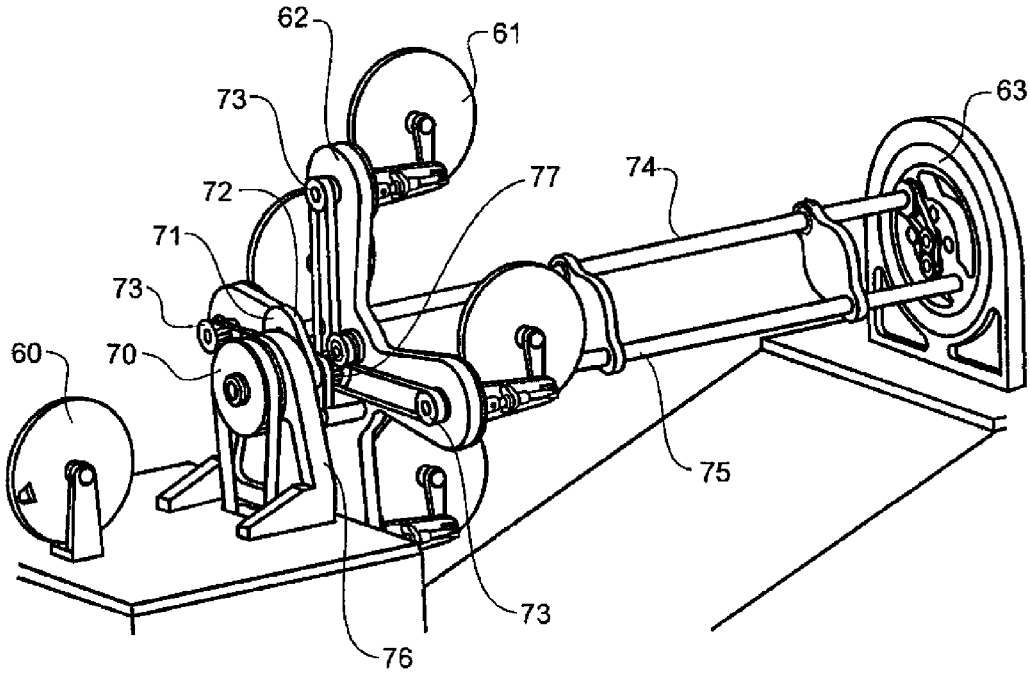
FIG. 7 is a partial perspective view of the embodiment illustrated in FIG. 6.

FIG. 7 shows in greater detail the drive arrangement for each of the rotating parts of the machine shown in FIG. 6. In this example, the rotating parts of the machine are all driven from single motor. This is a design choice and not essential to the working of the invention. Drive wheel 70 is mounted on a support 76, and rotates about a central axis. Drive wheel 70 is coupled to a motor (not shown) via a belt and any necessary gear assembly. Rotating member 62 is coupled to the drive wheel 70 via a cylindrical shaft (not visible in FIG. 7) so that rotation of the drive wheel causes rotation of the rotating member 63. Drive shafts 74, 75 are mounted to the rotating member 62 and extend through each of the wheels 63, 64, 65, 66, causing the wheels to rotate at the same angular velocity.

Mounted to support 76 is a static shaft around which various belts are placed. Aperture belt 72 passes around the static shaft and aperture wheel 71. Both the belt and the edges of the wheel and shaft are serrated to ensure that there is no slippage between the belt and the wheel and static shaft. Aperture wheel is fixed to drive shaft 74, and both wheel 71 and shaft 74 are free to rotate about their own axis while being supported by rotating member 62. Rotation of rotating member 62 causes counter rotation of aperture wheel 71 about its own axis owing to the action of the belt 72 on static shaft. The angular velocity of the shaft 74 about its own axis is determined by the gearing ratio between the aperture wheel 71 and the static shaft. The rotation of the drive shaft 74 about its own axis is used to rotate the apertures in each of the wheels 63, 64, 65, 66, as explained in detail with reference to FIG. 9.

Spool wheels 73 are coupled to the static shaft by belts. The spool wheels 73 are mounted to the rotating member 62 and support each of the second, third, fourth and fifth subconductor spools. Rotation of the rotating member 62 causes counter rotation of each of the spool wheels about their own axis, in the same manner as described with reference to aperture wheel 71. The rotation of wheels 73 about their own axes retains the spools 61 in a fixed vertical orientation throughout the rotation of rotating member 62. This means that the subconductors, which are typically flat, are all retained in the same orientation relative to each other. They are retained in this orientation throughout the machine. This means that the subconductors are not required to twist about their own axis during the winding process and so stress on the subconductors is minimised.

Figure 8:
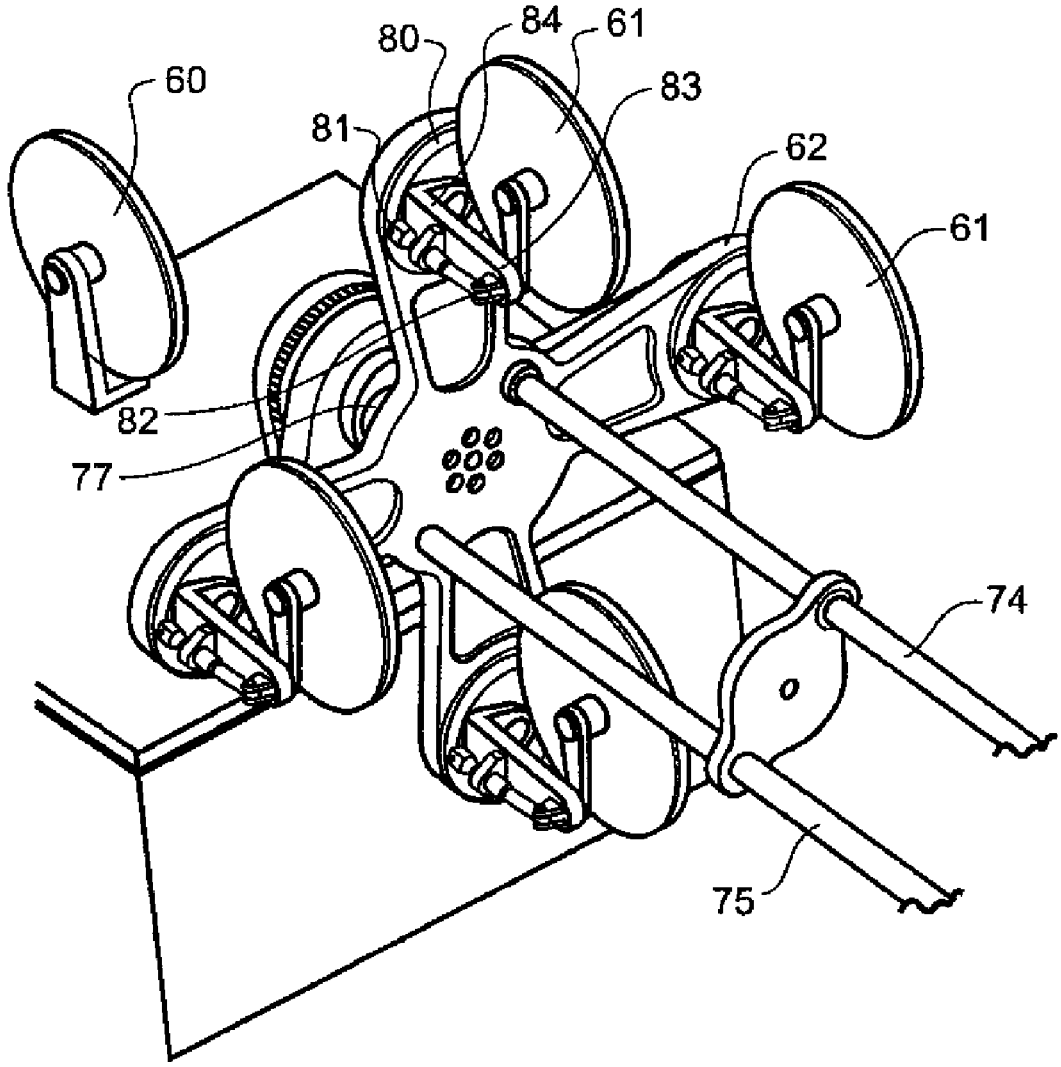
FIG. 8 shows detail of the subconductor spools in the embodiment illustrated in FIG. 6.

FIG. 8 is a perspective view of the cable spools 61 and their mounting on rotating member 62 in the machine shown in FIGS. 6 and 7. As already described, the spools 61 are retained in a vertical orientation throughout their rotation about the central axis. In order to minimize bending of the subconductors, the spools are also angled so that the subconductors come off each spool pointing towards the central axis. This angle is maintained throughout rotation about the central axis by the use of a variable height disc 80 and a cam follower 81. The variable height disc 80 is fixed to the rotating member 62. The spool is mounted to the rotating member 62 via a support arm 84 that is connected to the spool wheel 73. The cam follower 81 is mounted to the spool 61 via an articulated connector 82 that is connected to the spool support arm via pin 83. As the spool 61 rotates relative to the rotating member 62, the cam follower travels around the upper surface of the disc 80. Movement of the cam follower caused by the profile of the disc causes the articulated connector and hence the spool to pivot about the pin 83. The disc 80 is profiled to maintain a constant angle between the central axis and the spool.

Figure 9:
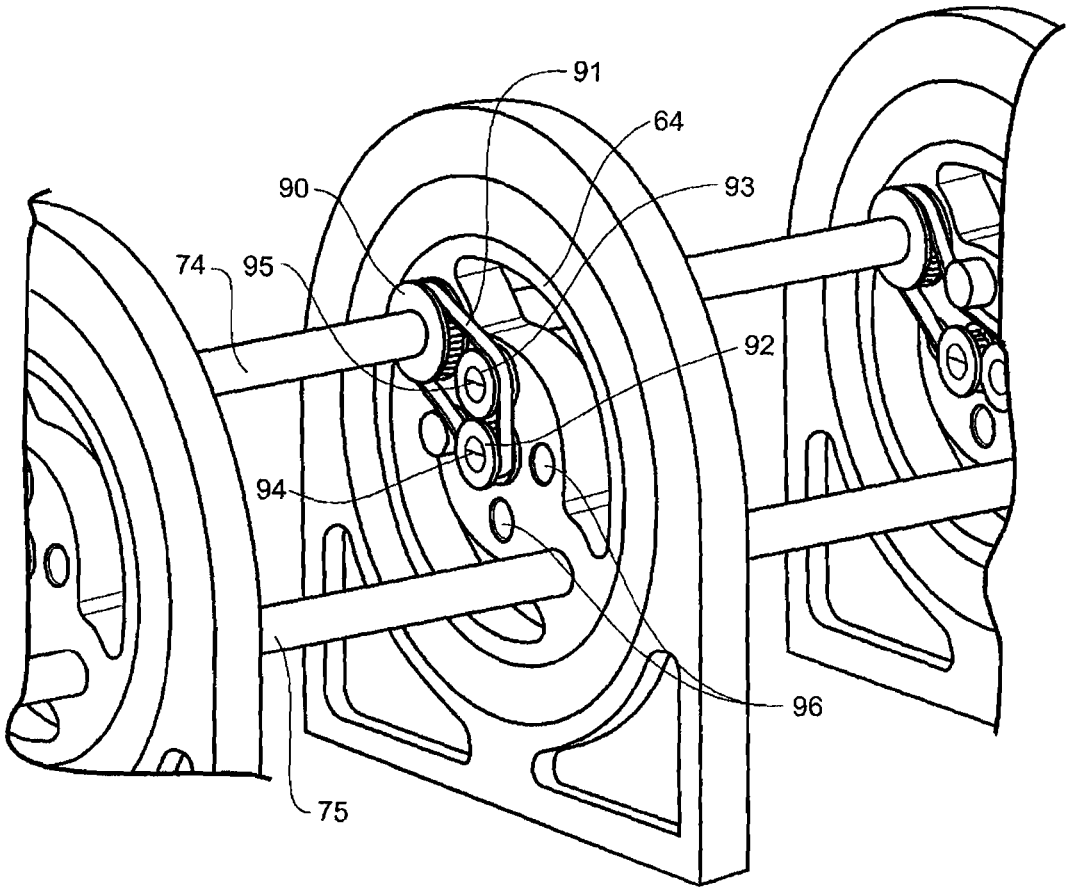
FIG. 9 shows detail of one of the rotating wheels in the embodiment illustrated in FIG. 4.

FIG. 9 shows one of the rotating wheels 63, 64, 65, 66 in more detail. The wheel 64 is supported in a circular bearing race. The wheel is driven by drive shafts 74, 75, as previously explained. The wheel includes a plurality of apertures through which subconductors pass. A central aperture 92 includes a counter rotating insert with a slit 94 formed through it. The slit counter rotates so as to remain in a horizontal configuration. The counter rotation is provided by a belt 91 extending around the insert and a drive wheel 90 fixed to drive shaft 74. As previously described, drive shaft 74 rotates about its own axis. By choosing a gearing ratio between insert 92 and wheel 90 that matches the gearing ratio between aperture wheel 71 and static shaft 77, the slit 94 is maintained horizontal. An additional insert 93, offset from the central axis, including a slit 95, is also included within the belt 91 so that slit 95 is held horizontal. Further apertures 96 are offset from the central axis and do not include an insert.

The subsequent and preceding wheels 63, 65, 66 are almost identical but the position of the insert 93 changes from wheel to wheel for reasons that will be clear when the operation of the machine is described.

Figure 10:
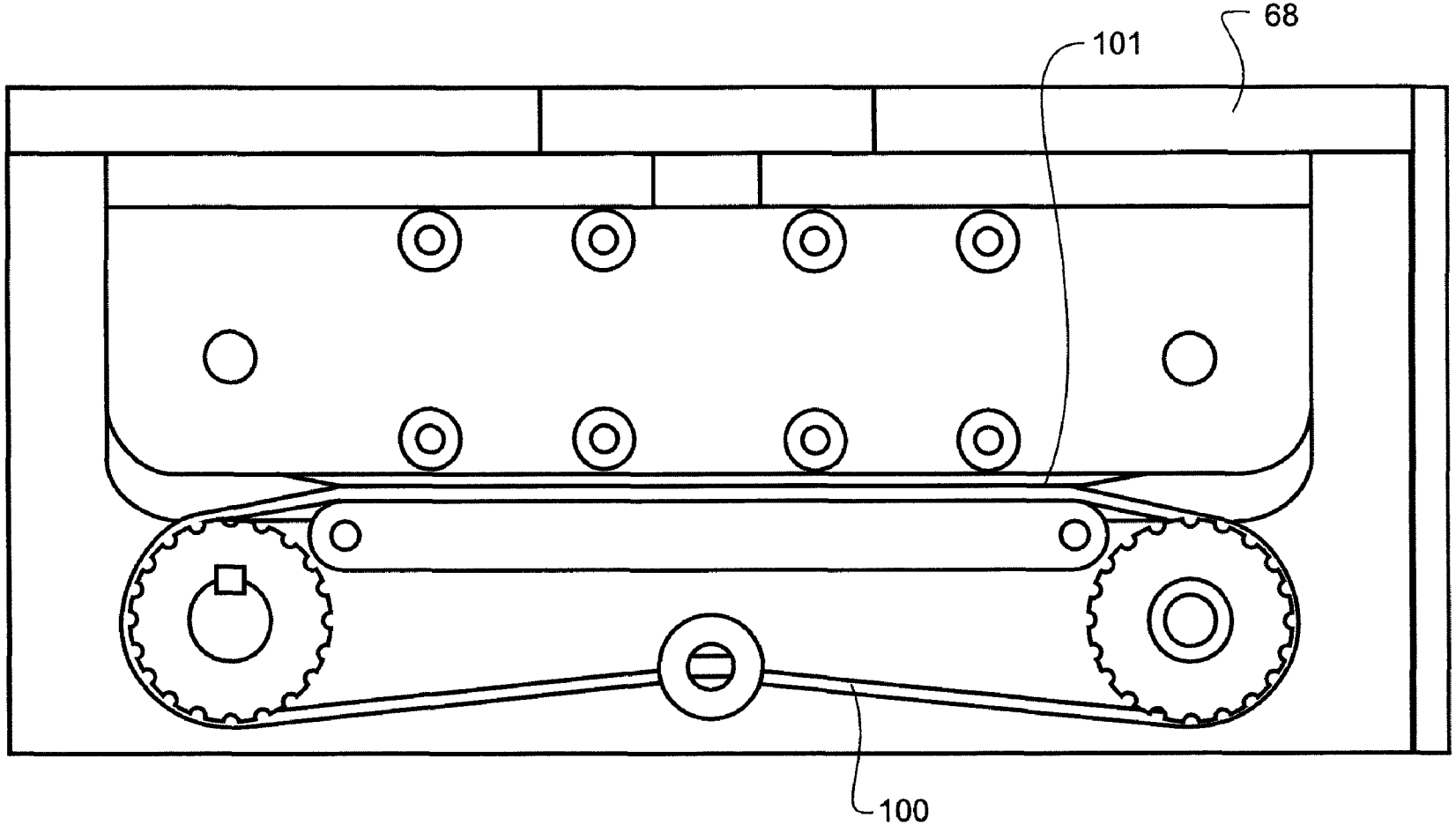
FIG. 10 shows detail of the take up clamp illustrated in FIG. 6.

FIG. 10 is a cross-section of drive unit 68. The drive unit consists of a pair of opposing travelling belts 100, 101. The belts contact each other for a length at least as great as a transposition length of the subconductors used in the machine. The transposition length is the period of the serpentine conductors. The wound subconductors are gripped between the belts 100, 101 and pulled through the machine. By gripping an entire transposition length at all times there is equal force applied to each subconductor, which minimizes stress on the subconductors. One or both of the belts 100, 101 are driven by a servo motor (not shown) that is synchronised with the motor used to drive the rotating parts of the machine to ensure that the subconductors are held at a desired tension.

In use, each of the subconductor spools provides a length of subconductor running through the machine. The machine performs a sequential winding of the subconductors to produce a composite cable.

To set the machine up the subconductors are fed through the machine in the following manner.

At the first wheel 63, a first subconductor passes through the central slit 94. A second subconductor passes through an offset slit 95 and third, fourth and fifth subconductors each pass through apertures 96. The second, third, fourth and fifth subconductors each pass through the aperture aligned with their respective spool 61. The relative longitudinal positions of the subconductors can be chosen to ensure that they wind around each other in the desired position with respect to their transition sections. Control of the longitudinal position of the subconductors can be carried out automatically using optical sensors (or other suitable sensors) during machine set up.

At the second wheel 64, the first subconductor and the second subconductor pass through the central slit 94. The third subconductor passes through an offset slit 95 and fourth and fifth subconductors each pass through apertures 96. The third, fourth and fifth subconductors each pass through the aperture aligned with their respective spool 61.

At the third wheel 65, the first, second and third subconductors pass through the central slit 94. The fourth subconductor passes through offset slit 95 and the fifth subconductor passes through pass though an aperture 96.

At the fourth wheel 66, the first, second, third and fourth subconductors pass through the central slit 94. The fifth subconductor passes through an offset slit 95.

All five subconductors pass through a stationary slit 59, through the drive means 68 and on to the take up spool 69.

When the machine is on, the drive means 68 pulls the subconductors through the machine. The winding of the second subconductor around the first subconductor is achieved by passing both the first and second subconductors through slit 94 on the second wheel 64 while the second subconductor rotates about the first subconductor. The winding of the of the successive subconductors is achieved in the same manner at subsequent wheels and finally at stationary slit 59.

The first wheel is used to bring the first and second subconductors under tight control by passing them through slits 94 and 95 respectively. It is desirable to include this stage to ensure that the subconductors are not flexing or twisting as they are being wound. Any flexing or twisting during winding would result in stress on the subconductors. For this reason at each wheel a slit 95 is used to stabilise the subconductor to be wound at the next stage. That is why slit 95 appears in a different position on each wheel. The other unwound subconductors do not need to be stabilised until a subsequent stage and so simply pass through apertures 96.

Guide plate 67 is also provided to support the subconductors during rotation. Any desired number of guide plates can be provided at various stages in the apparatus.

A number of constructional variations are possible while still retaining the same basic operation. For example, it is possible to drive each wheel from a separate synchronised motor. Alternatively, the drive shafts could be provided outside the extent of the wheels and coupled to the wheels using an arrangement of gear wheels. In these configurations, the outer rims of the wheels 63,64,65,66 could be driven by frictional engagement or interference fit with a drive wheel.

It might also possible for the first subconductor to rotate about its own longitudinal axis.

The foregoing describes the invention including a preferred form thereof. Alterations and modifications as will be obvious to those skilled in the art are intended to be incorporated within the scope hereof as defined in the accompanying claims.

Figure 11A:
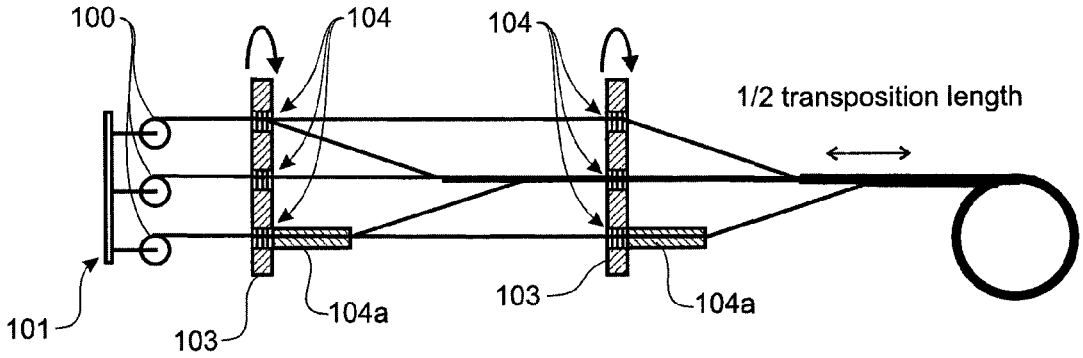
FIGS. 11*a* and 11*b* are schematic illustrations of alternative embodiment cable winding machines in accordance with the invention; and F
Figure 11B:
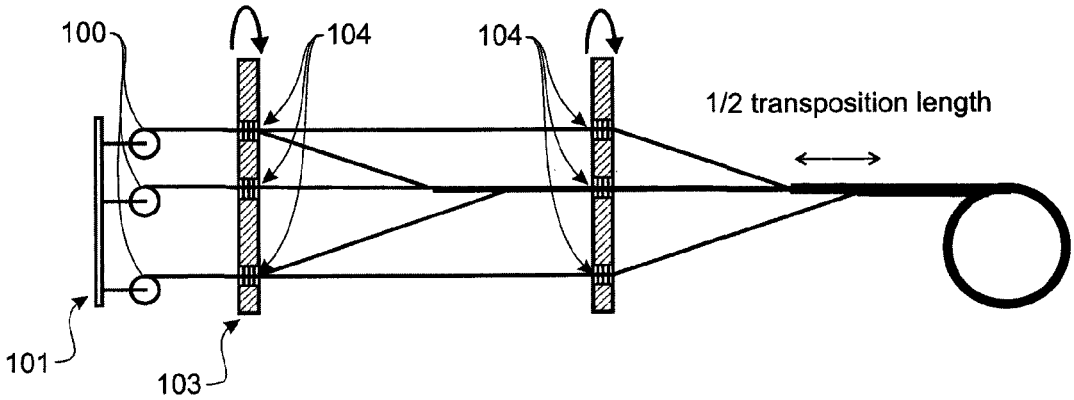

Alternative embodiments of machines are illustrated in FIGS. 11*a* and 11*b*. These embodiments are similar in construction to that of FIGS. 6-10 and are illustrated schematically in FIGS. 11*a* & 11*b*. In each case the machine has a series of spools 100 from which subconductors are fed, which are attached to a rotating spool holder 101 which allows the spools 100 to maintain a fixed orientation. As in the embodiments described previously a central subconductor moves through the machine along a central axis substantially without twisting, and may be guided by a series of apertures which can be placed essentially anywhere along this axis provided they do not interfere with the winding operations.

It is important to maintain a constant angle called the "winding angle" between the central subconductor and the subconductor being wound, herein after referred to as the "active subconductor". The position at which the active subconductor first contacts the central subconductor is called the "winding point". The active subconductor passes through a slot guide 102 located in a rotating wheel or guide carrier 103 similar to those 63-66 described previously. The slot guide 104 for each active subconductor counterrotates to maintain a substantially constant orientation of the active subconductor, also as described previously. After passing through the slot guide the active subconductor is oriented longitudinally at the winding angle to the central subconductor.

It is desirable when winding multiple subconductors that the winding points for each active subconductor are separated to prevent fouling. The winding points are preferably separated by a minimum of half a transposition length L of the subconductors. This can be achieved be either as shown in FIG. 11*a* by the second active subconductor having an extended slot guide 104*a* in it's carrier 103, or as shown in FIG. 11*b* the active slot guide being spaced at a larger radius from the central axis. The rotating guide carriers 103 can accommodate multiple slot guides as long as the winding angle is maintained constant and the winding points are sufficiently well separated. In FIGS. 11*a* & 11*b* two rotating guide carriers 103 are shown but the machine can include any number necessary to wind the desired number of subconductors.

Rotation of the slot guides 104 to retain their predetermined orientation can be via belts and wheels and can be driven from each rotating guide carrier 103 via a drive shaft as described previously. Alternatively the rotating guide carriers can be gear driven from the drive shaft, or from an electronically controlled motor.

In order to wind the cable as illustrated in FIG. 2 the subconductors are fed initially with a longitudinal displacement between the transition sections 11 of each subconductor. As the central subconductor is passed through the machine a series of active subconductors is added to the cable. To evenly spaced the subconductors, for the first active subconductor added to the central subconductor the displacement will be L/n where n is the total number of subconductors to be wound in the cable. The first active subconductor with a displacement in the forward direction of L/n, the second active subconductor with a displacement in the same direction of 2L/n, and so on for subsequent subconductors.

Figure 12:
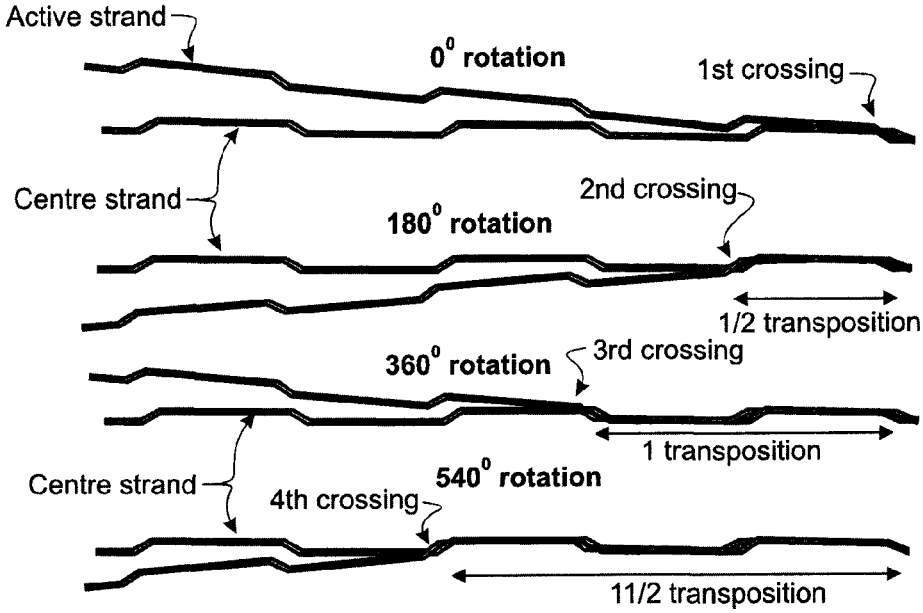
FIG. 12 is a detailed illustration of the winding method.

FIG. 12 illustrates the winding motion in further detail.

The winding point is located where two crossover regions 'lock' together. With a rotation of 180 degrees of the active subconductor, around the centre subconductor, the winding point will move ½ of the transposition length L down the centre subconductor; i.e. the rotational position (called the rotational phase) of the active subconductor will correlate with the winding point along the centre subconductor. This is illustrated in FIG. 12. For 0 degrees rotation the winding point is at the first crossover point to the right. After 180 degrees rotation the winding point has moved L/2 to the left, after a further 180 degree rotation the contact point moves another L/2 to the left and so on.

Preferably the winding angle should remain approximately the same. In order to achieve this a 'step' and 'rotate' procedure is preferred. This comprises the steps of:

1. Rotating the active subconductors by 180 degrees
2. Translating all subconductors longitudinally through the machine by ½ transposition length.
3. Repeating these steps until complete In the embodiment shown the slot guides 104 for the central subconductor are located within the rotating guide carriers 103 but they may alternatively be located anywhere that does not interfere with the winding operations.

After winding all subconductors of the cable the cable is wound onto a cable spool.

The invention claimed is:

1. A cable winding machine for winding a plurality of subconductors into a cable comprising:

a subconductor feeder or feeders arranged to move through the machine in a machine direction multiple subconductors having a width dimension across a longitudinal axis greater than a depth dimension through the longitudinal axis perpendicular to the width direction, as the subconductors are wound together into a cable by the machine;

a holder arranged to hold a first subconductor as it moves forward through the machine;

a first winder arranged to rotate a second subconductor about the first subconductor as the first and second subconductors move through the machine in the machine direction, so that the second subconductor winds with the first subconductor, and to hold the second subconductor in a predetermined orientation as the first winder rotates the second subconductor about the first subconductor so that the width dimension of the second subconductor remains substantially parallel to the width dimension of the first subconductor as the subconductors are wound together;

a first aperture in the machine direction through which the first and second subconductors can move in the machine direction;

a second winder after the first winder in the machine direction and arranged to rotate a third subconductor about the first and second subconductors as the first and second subconductors move through the machine in the machine direction, so that the third subconductor winds with the first and second subconductors, and to hold the third subconductor in a predetermined orientation as the second winder rotates the third subconductor about the first and second subconductors so that the width dimension of the third subconductor remains substantially parallel to the width dimensions of the first and second subconductors as the subconductors are wound together; and a second aperture in the machine direction through which the first, second, and third subconductors can move in the machine direction.

2. A cable winding machine according to claim 1, also comprising one or more further winders after the second winder in the machine direction, each further winder arranged to rotate an additional subconductor about subconductors wound together by the prior winders so that the additional subconductor winds following the further winder with the subconductors wound together by the prior winders, the additional subconductor having a width dimension across a longitudinal axis greater than a depth dimension through the longitudinal axis perpendicular to the width direction and the further winders being arranged to hold the additional subconductor in a predetermined orientation so that the width dimension of the additional subconductor remains substantially parallel to the width dimension of subconductors wound together by the prior winders as the further winder rotates the additional subconductor about the subconductors wound together by the prior winders.

3. A cable winding machine according to claim 1, wherein each winder is arranged to hold a subconductor by a holder arranged to counter rotate within the winder and about the machine direction, as the winder rotates about the machine direction, to maintain the subconductors in said predetermined orientation.

4. A cable winding machine according to claim 2, wherein each winder is arranged to hold a subconductor by a holder arranged to counter rotate within the winder and about the machine direction, as the winder rotates about the machine direction, to maintain the subconductors in said predetermined orientation.

5. A cable winding machine according to claim 1, wherein the first aperture is in a holder arranged to counter rotate within the second winder and about the machine direction, as the second winder rotates about the machine direction, to maintain the subconductors in said predetermined orientation, and wherein the first aperture has a dimension across the machine direction greater than another dimension through the machine direction perpendicular to the width direction.

6. A cable winding machine according to claim 2, wherein the first aperture is in a holder arranged to counter rotate within the second winder and about the machine direction, as the second winder rotates about the machine direction, the second aperture is in a holder arranged to counter rotate within a third winder and about the machine direction, as the third winder rotates about the machine direction, to maintain the subconductors in said predetermined orientation, and wherein the first and second apertures have a dimension across the machine direction greater than another dimension through the machine direction perpendicular to the width direction.

7. A cable winding machine according to claim 3, wherein each holder mounted in a winder for said counter rotation is geared to the winder to drive the holder to counter rotate relative to the winder as the winder rotates in another direction, and at a speed which maintains a subconductor passing through the holder in said predetermined orientation.

8. A cable winding machine according to claim 4, wherein each holder mounted in a winder for said counter rotation is geared to the winder to drive the holder to counter rotate relative to the winder as the winder rotates in another direction, and at a speed which maintains a subconductor passing through the holder in said predetermined orientation.

9. A cable winding machine according to claim 5, wherein each holder mounted in the winder for said counter rotation is geared to the winder to drive the holder to counter rotate relative to the winder as the winder rotates in another direction, and at a speed which maintains a subconductor passing through the holder in said predetermined orientation.

10. A cable winding machine according to claim 6, wherein each holder mounted in a winder for said counter rotation is geared to the winder to drive the holder to counter rotate relative to the winder as the winder rotates in another direction, and at a speed which maintains a subconductor passing through the holder in said predetermined orientation.

11. A cable winding machine for winding a plurality of subconductor tapes into a cable, comprising:

a tape feeder or feeders to move multiple subconductor tapes through the machine in a machine direction as the subconductor tapes are wound together into a cable by the machine;

a holder which holds a first subconductor tape as it moves forward through the machine;

a first winder arranged to rotate a second subconductor tape about the first subconductor tape as the first and second subconductor tapes move through the machine in the machine direction, so that the second subconductor tape winds with the first subconductor tape, and to hold the second subconductor tape in a predetermined orientation as the first winder rotates the second subconductor tape about the first subconductor tape, so that width dimensions of the subconductor tapes remain substantially parallel to one another as the subconductor tapes move through the machine and are wound together;

a first aperture in the machine direction through which the first and second subconductor tapes move in the machine direction, the first aperture having a dimension across the machine direction greater than another dimension through the machine direction perpendicular to the width direction;

a second winder after the first winder in the machine direction and arranged to rotate a third subconductor tape about the first and second subconductor tapes as the first and second subconductor tapes move through the machine in the machine direction, so that the third subconductor tape winds with the first and second subconductor tapes, and arranged to hold the third subconductor tape in a predetermined orientation as the second winder rotates the third subconductor tape about the first and second subconductor tapes, so that a width dimension of the third subconductor tape remains substantially parallel to width dimensions of the first and second subconductor tapes as the subconductor tapes move through the machine and are wound together; and a second aperture in the machine direction through which the first, second, and third subconductor tapes move in the machine direction, the second aperture having a dimension across the machine direction greater than another dimension through the machine direction perpendicular to the width direction, whereby the first aperture is in a holder arranged to counter rotate within the second winder and about the machine direction, as the second winder rotates about the machine direction.

12. A cable winding machine according to claim 11, also comprising one or more further winders after the second winder in the machine direction, each further winder arranged to rotate an additional subconductor tape about the subconductor tapes wound together by the prior winders so that said additional subconductor tape winds with the subconductor tapes wound together by the prior winders, each of said one or more further winders being arranged to hold a respective additional subconductor tape in a predetermined orientation as it rotates the additional subconductor tape about the subconductor tapes wound together by the prior winders, and wherein the second aperture is in a holder arranged to counter rotate within said further winder after the second winder and about the machine direction, as the third winder rotates about the machine direction to maintain the subconductor tapes in said predetermined orientation.

13. A cable winding machine for winding a plurality of serpentine subconductor tapes into a cable, comprising:

a tape feeder or feeders to move multiple serpentine subconductor tapes through the machine in a machine direction as the subconductor tapes are wound together into a cable by the machine;

a holder which holds a first serpentine subconductor tape as it moves forward through the machine;

a first winder arranged to rotate a second serpentine subconductor tape about the first subconductor tape as the first and second subconductor tapes move through the machine in the machine direction, with a predetermined longitudinal displacement of the second subconductor tape relative to the first subconductor tape, and to hold the second subconductor tape in a predetermined orientation relative to the first subconductor tape as the first winder rotates the second subconductor tape about the first subconductor tape, so that width dimensions of the subconductor tapes remain substantially parallel to one another as the subconductor tapes move through the machine and are wound together, so that the second subconductor tape winds with the first subconductor tape; and a second winder after the first winder in the machine direction and arranged to rotate a third serpentine subconductor tape about the first and second subconductor tapes as the first and second subconductor tapes move through the machine in the machine direction, with a predetermined longitudinal displacement of the third subconductor tape relative to the first and second subconductor tapes, and to hold the third subconductor tape in said predetermined orientation as the third subconductor tape moves forward through the machine and as the second winder rotates the third subconductor tape about the first and second subconductor tapes so that a width dimension of the third subconductor tape remains substantially parallel to width dimensions of the first and second subconductor tapes as the subconductor tapes move through the machine and are wound together, so that the third subconductor tape winds with the first and second subconductor tapes.

14. A cable winding machine according to claim 13, also comprising one or more further winders after the second winder in the machine direction, each further winder arranged to rotate an additional serpentine subconductor tape about the subconductor tapes wound together by the prior winders and with a predetermined longitudinal displacement, so that said additional subconductor tape winds with the subconductor tapes wound together by the prior winders, each of said one or more further winders being arranged to hold a respective additional subconductor tape in said predetermined orientation as the further winder rotates the additional subconductor tape about the subconductor tapes wound together by the prior winders.

15. A cable winding machine according to claim 13, wherein each winder is arranged to hold the subconductor tapes which it winds, by a holder arranged to counter rotate within the winder and about the machine direction, as the winder rotates about the machine direction, to maintain the subconductor tape in said predetermined orientation.

16. A cable winding machine according to claim 14, wherein each winder is arranged to hold the subconductor tape which it winds, by a holder arranged to counter rotate within the winder and about the machine direction, as the winder rotates about the machine direction, to maintain the subconductor tape in said predetermined orientation.

17. A cable winding method for winding a plurality of subconductors into a cable, comprising:

moving multiple subconductors through a cable winding machine in a machine direction, said multiple subconductors having a width dimension across a longitudinal axis greater than a depth dimension through the longitudinal axis perpendicular to the width direction;

holding a first subconductor as it moves through the machine;

rotating a second subconductor about the first subconductor as the first and second subconductors move through the machine, while holding the subconductors in a predetermined orientation relative to one another so that the width dimensions of the subconductors remain parallel as the subconductors move through the machine and while rotating the second subconductor about the first subconductor, so that the second subconductor winds with the first subconductor, and then subsequently in the machine direction; and rotating a third subconductor about the first and second subconductors as the first, second and third subconductors move through the machine, while holding the subconductors in a predetermined orientation relative to one another so that the width dimension of the third subconductor remains substantially parallel with the width dimensions of the first and second subconductors as they move through the machine and while rotating the second subconductor about the first subconductor, so that the third subconductor winds with the first and second subconductors.

18. A method according to claim 17, comprising subsequently in the machine direction rotating one or more other subconductors so a first other subconductor winds with the first, second, and third subconductors and thereafter in the machine direction any other further subconductors wind one after another with the subconductors wound together previously.

19. A method according to claim 18, wherein the subconductors have a serpentine shape.

20. A method according to claim 19, including rotating said second subconductor about the first subconductor with a predetermined longitudinal displacement of the second subconductor relative to the first subconductor, and rotating said third subconductor about the first and second subconductors with a predetermined longitudinal displacement of the third subconductor relative to the first and second subconductors.

21. A method according to claim 20, wherein the subconductors comprise a high $T_c$ superconducting layer.

22. A cable winding method for winding a plurality of serpentine subconductors into a cable, comprising:

moving multiple serpentine subconductors through a cable winding machine in a machine direction as the subconductors are wound together into a cable by the machine;

holding a first serpentine subconductor as it moves forward through the machine;

rotating a second serpentine subconductor about the first subconductor as the first and second subconductors move through the machine, with a predetermined longitudinal displacement of the second subconductor to the first subconductor and while holding said second subconductor in a predetermined orientation about a longitudinal axis of the second subconductor, so that the second subconductor winds with the first subconductor after the winder in the machine direction, and then subsequently in the machine direction; and rotating a third serpentine subconductor about the first and second subconductors as the first, second and third subconductors move through the machine, with a predetermined longitudinal displacement of the third subconductor relative to the first and second subconductors and while holding said third subconductor in a predetermined orientation about a longitudinal axis of the third subconductor, so that the third subconductor winds with the first and second subconductors.

23. A method according to claim 22, comprising rotating one or more other serpentine subconductors with a predetermined longitudinal displacement and while holding the one or more other serpentine subconductors in a predetermined orientation relative to subconductors wound together previously, so a first said other subconductor winds with the first, second, and third subconductors and thereafter any further other subconductors wind one after another with the subconductors wound together previously.

24. A method according to claim 23, wherein the subconductors each have a width dimension across a longitudinal axis greater than a depth dimension through the longitudinal axis perpendicular to the width direction and wherein holding the subconductors in said predetermined orientation comprises holding the subconductors with the width dimension of the subconductors parallel as the subconductors move through the machine.

25. A method according to claim 23, wherein the subconductors comprise a high $T_c$ superconducting layer.

26. A method according to claim 24, wherein the subconductors comprise a high $T_c$ superconducting layer.

* * * * *